United States Patent [19]

Brandstetter et al.

[11] Patent Number: 4,771,398

[45] Date of Patent: Sep. 13, 1988

[54] METHOD AND APPARATUS FOR OPTICAL RF PHASE EQUALIZATION

[75] Inventors: Robert W. Brandstetter, Levittown; Adrian R. Doucette, Garden City, both of N.Y.

[73] Assignee: Grumman Aerospace Corporation, Bethpage, N.Y.

[21] Appl. No.: 857,277

[22] Filed: Apr. 30, 1986

[51] Int. Cl.[4] ..... G06G 7/00

[52] U.S. Cl. ..... 364/807; 364/822

[58] Field of Search ..... 364/807, 602, 822; 324/77 K; 350/358, 162, 12; 332/31 R, 16 R

[56] References Cited

U.S. PATENT DOCUMENTS

| | | | |
|---|---|---|---|
| 3,462,603 | 8/1969 | Gordon . | |
| 3,544,806 | 12/1970 | DeMaria et al. . | |
| 3,602,725 | 8/1971 | DeMaria . | |
| 3,742,375 | 6/1973 | Farah . | |
| 4,012,120 | 3/1977 | Kagiwada et al. . | |
| 4,066,333 | 1/1978 | Dargent | 340/802 X |
| 4,351,589 | 9/1982 | Chavel | 364/713 X |
| 4,365,310 | 12/1982 | Green . | |
| 4,390,247 | 6/1983 | Freyre . | |
| 4,445,141 | 4/1984 | Benton et al. | 350/162.12 X |
| 4,448,494 | 3/1984 | Freyre | 350/358 |
| 4,460,250 | 7/1984 | Freyre | 350/358 |
| 4,503,388 | 3/1985 | Zehl et al. | 324/77 X |
| 4,522,466 | 6/1985 | Lindig et al. | 364/822 X |
| 4,531,196 | 7/1985 | Lid | 364/822 X |
| 4,633,170 | 12/1986 | Burns | 324/77 K |
| 4,636,718 | 1/1987 | Labrum | 324/77 K |
| 4,645,300 | 2/1987 | Brandstetter | 350/162.12 |

OTHER PUBLICATIONS

M. H. Brienza, "Variable Time Compression, Expansion, and Reversal of RF Signals by Laser-Acoustic Techniques", Applied Physics Letters, vol. 12, No. 5, Mar. 1, 1968, pp. 181-184.

*Primary Examiner*—Joseph Ruggiero
*Assistant Examiner*—Charles B. Meyer
*Attorney, Agent, or Firm*—Pollock, VandeSande & Priddy

[57] ABSTRACT

Phase equalization of a phase-distorted multifrequency signal is accomplished by acousto-optic modulating a coherent light beam with the signal taking the optical Fourier transform with the resultant Fourier plane containing all frequency components spatially distributed. A control array, positioned in the Fourier plane and/or local oscillator, contains adjacent elements having their birefringence variable with respect to each other thereby selectively altering the light path length and/or amplitude of each frequency component passing through the element. The resultant transformed image then undergoes optical down conversion to obtain the electrical signal having its phase equalized relative to the distorted input signal.

11 Claims, 1 Drawing Sheet

METHOD AND APPARATUS FOR OPTICAL RF PHASE EQUALIZATION

FIELD OF THE INVENTION

The present invention relates to phase equalization circuits, and more particularly to an optical circuit suited for RF signals.

BACKGROUND OF THE INVENTION

RF signals propagating through a medium generally experience non-linear phase characteristics, namely, phase varies nonlinearly with frequency. Without special processing, such a propagated signal will be detected as a degraded signal.

The prior art has made wide use of tapped delay lines (both digital and analog) which introduce different delays to different frequency components of an RF signal, the components being added at an output of the delay lines so that phase shifts of a propagated signal may be compensated, enabling the compensated signal to resemble the signal before propagation. As a result, information content of an original input signal may be preserved.

Although such prior art devices have been satisfactorily employed for years, they are severely restricted in the number of frequencies that can be handled by the digital electronics circuitry and the speed with which the equalization is activated.

BRIEF DESCRIPTION OF THE PRESENT INVENTION

The present invention utilizes coherent optical processing to perform phase equalization corrections of RF signals by providing equalization paths for a multitude of discrete frequencies in a parallel operation. By virtue of the present invention, thousands of discrete frequencies may be handled. As will be discussed hereinafter, the invention permits fixed or variable phase control for each of the frequencies which would not be possible by the prior art circuits.

After acousto-optical processing of a propagated distorted signal, a phase control array is introduced in the Fourier plane of the optical signal. The array is comprised of individual components that have their birefringence electrically altered and which correspondingly alters the phase of the particular frequency associated with the element. The corrected optical signal then undergoes photoelectric transformation at a photomixer and the result is a phase-equalized correction signal which corresponds to an input signal prior to its propagation-induced phase distortion.

BRIEF DESCRIPTION OF THE FIGURES

The above-mentioned objects and advantages of the present invention will be more clearly understood when considered in conjunction with the accompanying drawings, in which.

DETAILED DESCRIPTION OF THE PRESENT INVENTION

Figures 1, 2:
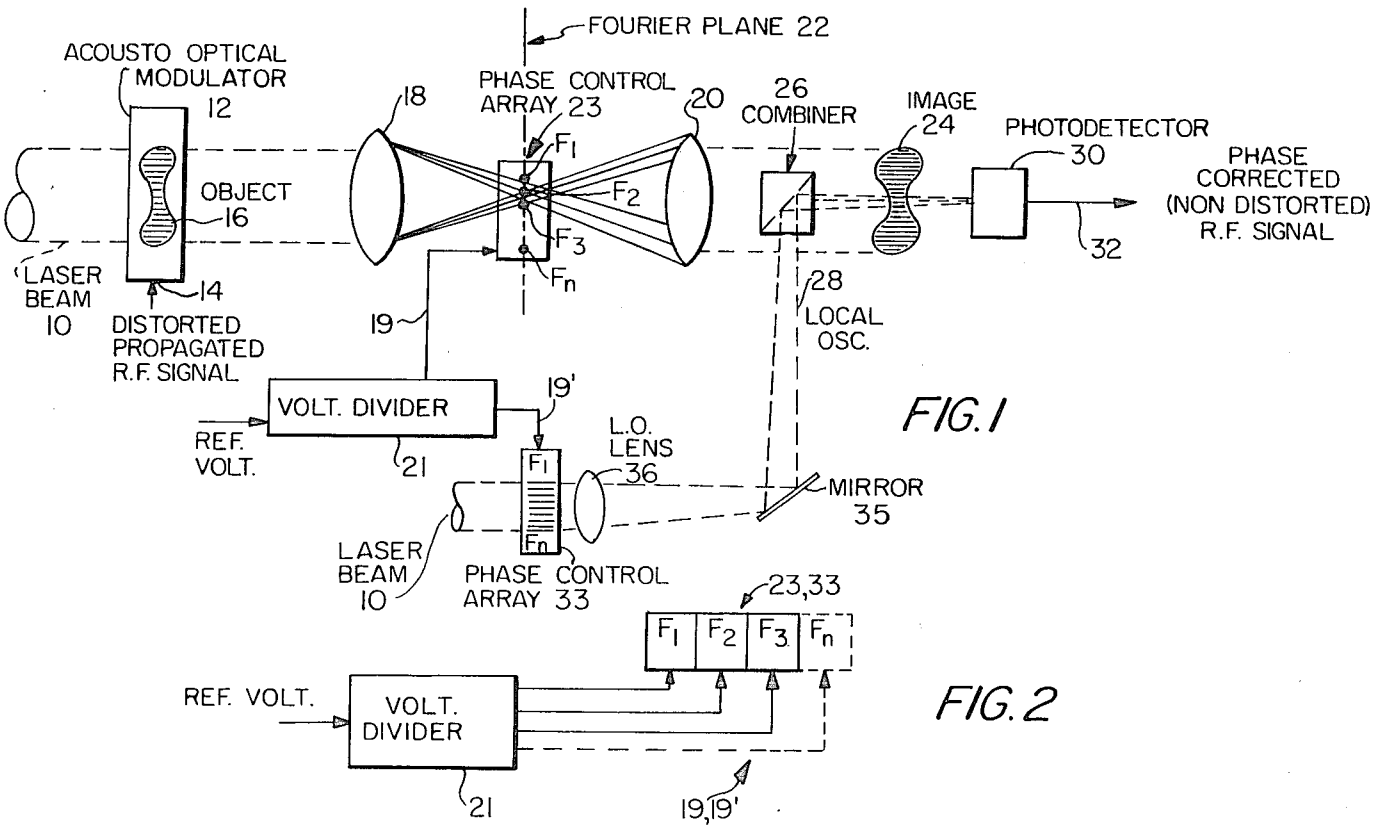
FIG. 1 is a diagrammatic top plan view of an electro-optic apparatus for achieving the inventive concept.
FIG. 2 is a partial diagrammatic view of a phase control array as employed in the present invention.

A laser beam 10 serves as an optical carrier signal for a modulating RF signal 14 which has been previously distorted as a result of propagation. The beam 10 and RF signal 14 are introduced to a conventional acousto-optical modulator 12, such as the type manufactured by the ISOMET Corporation; and a modulated acoustic field (object) 16 is formed by modulator 12.

A Fourier plane 22 is developed between Fourier lens 18 and inverse Fourier lens 20. By introducing a phase control array 23 at the Fourier plane 22, the phase equalization capability of the present invention may be realized. Specifically, there is a spatial frequency distribution of object 16 on the Fourier plane 22; and by placing a multi-optical element phase control array 23 in coplanar relationship with the spatial distribution, each frequency component of object 16, as spatially distributed, may undergo phase modification so that a phase-equalized optical signal results. Thus, as will be presently explained, the elements of the array produce desired phase control at each frequency component of the object 16.

To better understand the phase control array 23, reference is made to FIG. 2 wherein a multi-element electro-optic device is illustrated. The individual elements are schematically indicated by corresponding spatially distributed frequency components $F_1$–$F_n$. For purposes of simplicity, only a small number of frequency components is illustrated. However, it should be understood that the present invention is intended for a large number of frequency components, typically one thousand or more. Appropriate electro-optic devices include PLZT, liquid crystal, Kerr cells, Pockel cells, Faraday cells, and the like. The purpose of each element in the array is to vary the optical path length of the spatially distributed frequency components, at the Fourier plane 22, so that the birefringence of each element is varied as required to alter the optical path length of each element in a manner that will equalize the phase of each frequency component as it passes through the Fourier plane 22. As a result, the phase of an image located to the right of the inverse Fourier lens 20 is phase equalized relative to the distorted object 16.

The equalized image undergoes processing by combiner 26 which may be a conventional semi-silvered mirror. A laser local oscillator beam 28 forms a second optical input to the combiner 26 to achieve optical heterodyning or down converting thus forming the phase-equalized image 24 which impinges upon an intensity-sensitive square law photodetector 30 for transforming the corrected phase-equalized image 24 to a corrected RF signal at photodetector output 32. As a result, the RF signal at output 32 is a phase-corrected non-distorted signal resembling the original electrical signal which became distorted by propagation prior to introduction to the equalization circuitry of FIG. 1.

It should be pointed out that the phase shift occurring at each of the elements in array 23 can be continuously varied, as in the Kerr, Pockel cell and liquid crystal devices, or discretely varied as in a Faraday cell. The amount of phase shift occurring through each cell is controlled by a device which, in its basic form, may resemble a voltage divider 21 to which a reference voltage is applied. Individual output from the voltage divider, as generally indicated by reference numeral 19 (FIG. 2), drive each element of the array to a degree corresponding to the desired phase shift to be achieved by each element of the array 23.

The laser local oscillator beam 28, which forms the second optical input to the combiner 26 is derived from the laser beam 10. The local oscillator beam may be phase-controlled in a manner similar to that disclosed in connection with the signal path through the phase-control array 23. This is done by including a second phase-control array 33 similar in construction to the multi-optical element phase-control array 23. As in the case of the first array 23, the second phase-control array 33 modifies the phase of the laser beam 10 as it impinges upon each element of the array. The lens 36 focusses the phase-modified beam for reflection by mirror 35 to form the local oscillator beam 28. In fact, this beam will be comprised of phase-modified sections which correspond to the phase modifications to the object 16, as a result of phase-control array 23.

The inclusion of a phase-modified local oscillator beam is not mandatory. However, the utilization of both arrays 23 and 33 can be advantageously operated in parallel and/or tandem to achieve phase correction of a distorted propagated RF signal over a wide range of applications.

In accordance with the present invention, phase correction may be accomplished in three modes:

1. utilization of phase-control array 23 and a local oscillator beam 28 which does not undergo phase control through array 33;

2. phase control of the local oscillator beam 28 by utilization of array 33 and no utilization of a phase-control array 23 at the Fourier plane 22; and 3. utilization of phase-control arrays 23 and 33.

The degree of elemental local oscillator phase control is determined by the voltage divider output 19' in the same manner previously described in connection with voltage divider output 19, which drives the phase-control array 23.

Although the present invention illustrates a single pass device, if additional phase correction is required, multiple passes through the phase control arrays 23 and 33 may be accomplished by a recursive technique which may typically utilize mirrors (not shown) for achieving multiple passes.

The modification of the optical path length through each array element, corresponding to phase shift through that element, may be expressed by the equation:

$$\Delta\phi = 2\pi(\Delta t\, n_c C)/\lambda$$

where $\Delta t$ is the differential delay;

$n_c$ is equal to the refractive index of the element cell;

C is equal to the speed of light; and $\lambda$ is the wavelength of the laser beam 10.

Although the present invention has been described for radio frequencies, it is equally applicable to phase equalizing frequency components of other multi-frequency signals, regardless of the medium through which they propagate and encounter distortion.

In situations where amplitude equalization of signal frequency components is also necessary, this may be achieved by modifying the frequency components of the signal at the Fourier plane; additional amplitude equalization being possible by modifying the local oscillator beam. The means for so modifying the amplitude of individual frequency components is by utilizing arrays of light filtering elements, as disclosed in our copending patent application entitled METHOD AND APPARATUS FOR OPTICAL RF AMPLITUDE EQUALIZATION, Serial No.

It should be understood that the invention is not limited to the exact details of construction shown and described herein, for obvious modifications will occur to persons skilled in the art.

We claim:

1. A circuit for performing phase equalization on frequency components of an electrical signal, the circuit comprising:

means for modulating a coherent light beam with a multifrequency electrical input signal to form an image;

means for forming a Fourier plane and spatially distributing the frequency components of the image on the plane;

means located in the Fourier plane for controlling the optical path length at points in the plane thereby shifting the phase of each distributed frequency component to form a transformed image; and means for detecting the transformed image and forming a phase-equalized electrical output therefrom.

2. The circuit set forth in claim 1 wherein the modulating means comprises an acousto-optical modulator having:

an optical input communicating with a source of coherent light; and an electrical input terminal connected to the input signal.

3. The circuit set forth in claim 2 wherein the controlling means has an array of birefringent elements for selectively varying the optical path length of each spatially distributed frequency component; and further wherein the detecting means includes:

optical means for combining the transformed image and a local oscillator light beam for down-converting the transformed image, the local oscillator light beam being produced by a second array of birefringent elements for selectively varying the optical path of respective sections of the local oscillator light beam as the beam impinges upon the elements, thereby achieving phase control of the local oscillator beam sections; and a photodetector for changing the down converted image to an electrical signal which is phase equalized.

4. The circuit set forth in claim 1 wherein the Fourier plane-forming means comprises:

a Fourier lens positioned forwardly of the plane; and an inverse Fourier lens positioned rearwardly of the plane.

5. The circuit set forth in claim 1 wherein the controlling means comprises:

an array of birefringent elements for selectively varying the optical path length of each spatially distributed frequency component.

6. The circuit set forth in claim 1 wherein the detecting means comprises:

optical means for combining the transformed image and a local oscillator light beam for down-converting the transformed image; and a photodetector for changing the down converted image to an electrical signal which is phase equalized.

7. A circuit for performing phase equalization on frequency components of an electrical signal, the circuit comprising:

means for modulating a coherent light beam with a multifrequency electrical input signal to form an image;

means for forming a Fourier plane and spatially distributing the frequency components of the image on the plane;

means for combining the spatially distributed image with a local oscillator light beam for down converting the image;

photodetector means for changing the down converted image to an electrical signal which is phase equalized;

the local oscillator light beam being produced by means for selectively varying the light path of different sections of the local oscillator light beam thereby effecting selective phase control of the local oscillator beam sections.

8. A method for performing phase equalization on frequency components of an electrical signal, the circuit comprising:

modulating a coherent light beam with a multifrequency electrical input signal to form an image;

forming a Fourier plane and spatially distributing the frequency components of the image;

controlling the optical path length at points on the plane thereby shifting the phase of each frequency component and forming a transformed image; and detecting the transformed image and forming a phase-equalized electrical output therefrom.

9. The method set forth in claim 8 wherein controlling the optical path length at each point on the plane includes the step of selectively changing the birefringence at points on the plane.

10. The method set forth in claim 8 wherein detecting the transformed image includes the steps:

combining the transformed image and a local oscillator light beam for down converting the transformed image; and changing the down-converted image to an electrical signal which is phase equalized;

the local oscillator light beam produced by selectively varying the optical path of respective sections of the local oscillator light beam thereby achieving phase control of the oscillator beam sections; and detecting the down-converted image to produce a corresponding electrical signal which is phase equalized.

11. A method for performing phase equalization on frequency components of an electrical signal, the circuit comprising:

modulating a coherent light beam with a multifrequency electrical input signal to form an image;

forming a Fourier plane and spatially distributing the frequency components of the image;

combining the spatially distributed image with a local oscillator light beam for down converting the image; and changing the down-converted image to an electrical signal which is phase equalized;

the local oscillator light beam produced by selectively varying the optical path of respective sections of the local oscillator light beam thereby achieving phase control of the local oscillator beam sections.

* * * * *

UNITED STATES PATENT AND TRADEMARK OFFICE

CERTIFICATE OF CORRECTION

PATENT NO. : 4,771,398

DATED : September 13, 1988

INVENTOR(S) : Robert W. Brandstetter, et al.

It is certified that error appears in the above-identified patent and that said Letters Patent is hereby corrected as shown below:

Column 2, line 60, change "Individual output" to --Individual outputs--.

Column 3, line 66, after "Serial No." insert --857,288, which has issued as U.S. Pat. No. 4,771,397.--

Signed and Sealed this

Fourteenth Day of February, 1989

*Attest:*

DONALD J. QUIGG

*Attesting Officer*

*Commissioner of Patents and Trademarks*